US006503071B2

(12) United States Patent
Edwards

(10) Patent No.: US 6,503,071 B2
(45) Date of Patent: Jan. 7, 2003

(54) HIGH SPEED UNIVANE FLUID-HANDLING DEVICE

(76) Inventor: Thomas C. Edwards, 1426 Gleneagles Way, Rockledge, FL (US) 32955

( * ) Notice: Subject to any disclaimer, the term of this patent is extended or adjusted under 35 U.S.C. 154(b) by 0 days.

(21) Appl. No.: 09/729,505

(22) Filed: Dec. 4, 2000

(65) Prior Publication Data

US 2002/0068003 A1 Jun. 6, 2002

(51) Int. Cl.[7] ..... F01C 1/344; F01C 21/00
(52) U.S. Cl. ..... 418/151; 418/235; 418/265
(58) Field of Search ..... 418/151, 235, 418/265, 268

(56) References Cited

U.S. PATENT DOCUMENTS 828,260 A * 8/1906 Williams ..... 418/151
984,061 A * 2/1911 Augustine ..... 418/151
2,015,501 A * 9/1935 Sorge ..... 418/11
3,099,964 A * 8/1963 Eickmann ..... 418/268
3,102,493 A * 9/1963 Davin ..... 418/268
5,374,172 A 12/1994 Edwards ..... 418/151

FOREIGN PATENT DOCUMENTS

WO 89/02533 * 3/1989

* cited by examiner

*Primary Examiner*—John J. Vrablik
(74) *Attorney, Agent, or Firm*—R. W. Jensen

(57) ABSTRACT

A single vane gas displacement apparatus comprises a stator housing with a right cylindrical bore enclosing an eccentrically mounted rotor which also has a radial slot in which is movably radially positioned a single vane. The vane is tethered to antifriction vane guide assemblies concentric with the housing bore. Then vane has a preselected center of gravity located proximate to the housing bore axis. An option is to have a port in said vane for ducting high-pressure gas to the inlet side to react against the rotor slot to reduce vane contact therewith.

3 Claims, 7 Drawing Sheets

1b
1c
AA
10
100
GO
OUTLET
GI
INLET
36
14
1b
1c

AA
10
15
36
15"
GO
14
25
14"

10
15
36'
35
20'
℄R
℄S
36
15"
55
177
60"
12
18
45"
77'
81
81'
40
L
AA
14
26
25
19'
14"
D

60/55
85
84'
75
83'
76'
60'
81
C.G.V
18B
18V
20'
18P
18
18A
177
19'
176
W
176'
176''
2d
14'
14
60
55
56
62
77
81
76
83
84
84''
45'
45
40
41
81'
123
3a
3c
77'

FIG. 6b
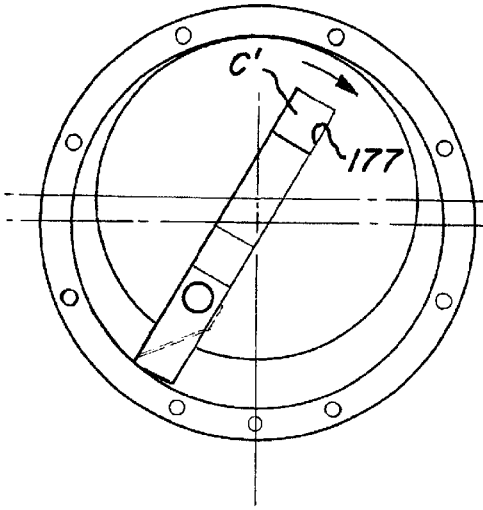
FIG. 6c
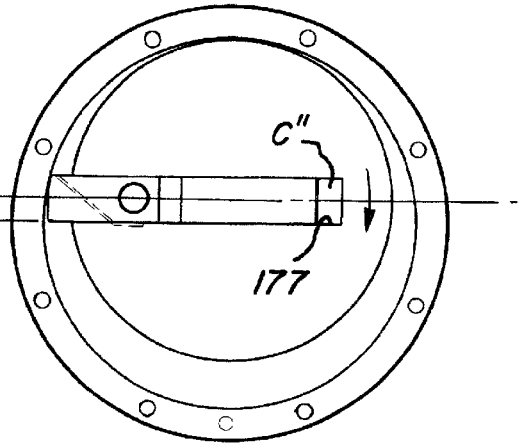
FIG. 6a
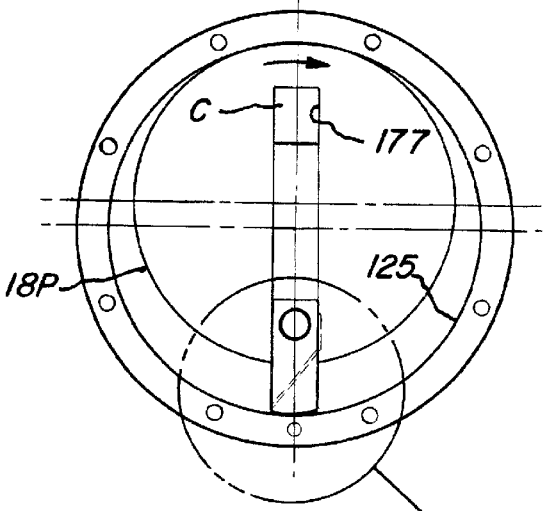
FIG. 6f
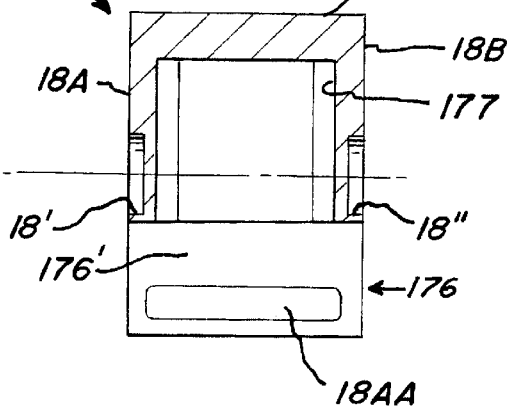
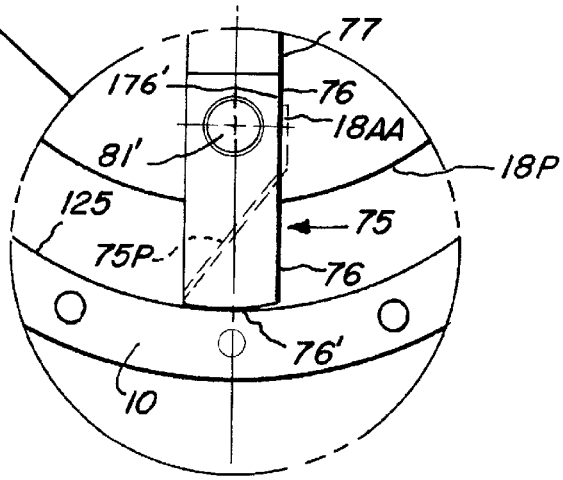
FIG. 6e

HIGH SPEED UNIVANE FLUID-HANDLING DEVICE

BACKGROUND OF THE INVENTION

My previous U.S. Pat. No. 5,374,172 (hereinafter "the '172 invention" ), entitled ROTARY UNIVANE GAS COMPRESSOR and issued Dec. 20, 1994 (and corresponding non-domestic patents), teaches a fluid-handling device that employs a single vane (hereinafter sometimes referred to as "UniVane") which, in combination with its attending components, can pump, compress or expand fluids. Importantly, this single vane is tethered opposite its tip by two anti-friction bearings, one placed on each side of the vane. This unique arrangement precisely controls the radial location of the vane tip such that it operates within very close sealing proximity—but not in physical contact with—the internal surface of the stator cylinder.

This important and distinguishing feature of the UniVane compressor, by eliminating vane tip friction but effectively preserving the sealing of the dynamic interface between the vane tip and its attending stator wall, results not only in a very reliable machine but one of great energy efficiency due to the minimization of mechanical friction.

Another advantage of the '172 invention is that it can be operated in an oil-less mode because the machine can be fitted with lifetime-lubricated sealed anti-friction bearings that, further, are not even within the flow field of the fluid being processed. At ordinary rotor shaft speeds, the centrifugal force tugging at the vane tip tether pin resulting from the rotating mass of the vane is modest.

However, being a function of the square of the rotor RPM, this centrifugal tether force quickly becomes excessive with increasing speed, thus rapidly setting a practical speed limit (RPM) for the rotor shaft of the '172 invention. The present invention greatly decreases this limitation thus allowing significantly higher speed single vane or UniVane operation. Among other advantages, this greatly decreases the size and weight of the machine while simultaneously significantly increasing its throughput.

While this improvement is not of particular commercial importance to some oil-less applications, a new and challenging requirement has arisen. This application requires the efficient supply of large quantities of relatively low-pressure clean air over a very wide range of operation, i.e., energy demands of fuel cells for automobiles, trucks, buses and the like (hereinafter "automotive fuel cells"). In this application, of course, the size and weight of the air supply equipment is of great significance. Although achieved in a far more efficient and ecological manner, air-breathing fuel cells, like combustion engines, combine hydrogen and oxygen in order to produce power.

This new air delivery requirement for fuel cells has not been served well by conventional fluid-handling devices because they were neither conceived nor designed for the unique air flow needs of fuel cells which, again, require relatively large amounts of flow at relatively low pressures. The uniqueness resides in the limitations of the only two fundamental types of mechanisms than can be used to compress, expand, and pump fluids: positive-displacement or momentum-conversion devices.

Basic Compressor Types

There are two fundamental means to provide compression (and pumping and expansion) of fluids: positive displacement machines and momentum-conversion machines. These types of devices are fundamentally different and their operating characteristics dictate whether or not they are adaptable to a given application. Positive-displacement machines achieve the compression of a gas by diminishing its volume through the relative motion of physical surfaces containing the gas. Prominent examples of such mechanisms include piston-cylinders and conjugate screws and scrolls.

Momentum-conversion devices, on the other hand, achieve compression by causing the gas to increase its speed, thereby absorbing kinetic energy, and then quickly slowing it down. This reduction in velocity converts the fluid's kinetic energy to potential energy, thus compressing the gas. Such machines are known variously as centrifugal pumps, fans, and turbines, and all operate on the same physical principle.

The functional differences between positive displacement and turbine-type devices are manifested in quite dissimilar operating characteristics. Specifically, the flow rate of positive-displacement pumps is almost directly proportional to shaft speed and their pressure ratio is nearly independent of speed. Conversely, turbo-machines, which rely upon kinetic energy to compress gases, are very non-linear devices. Their flow rate is proportional to the cube of their speed and their pressure ratio varies as the square ofrotor RPM. On the other hand, turbo devices can operate at very high speeds and are, therefore, much smaller than conventional positive displacement machines for the same rate of flow delivery. These elemental distinctions turn out to be very important, depending upon the air delivery and operational requirements of the machine.

In the case of propulsion fuel cells, these differences are of fundamental importance because the power requirement for an automotive fuel cell can vary greatly from instant to instant. Also, it is advantageous to operate automotive fuel cells at a constant air pressure across a very large range of loads. This load range, known also as the "turn-down ratio," is very significant for a land vehicle.

Interestingly, this principle is the root reason that gas turbines, used as a land vehicle prime mover, have proven unable to commercially compete with conventional internal combustion engines. Internal combustion engines, diesel or spark ignition, are positive displacement devices whose power and torque characteristics can far more easily accommodate the variable-load performance required by land vehicles than turbo-machines. It is therefore not altogether surprising that turbo compressors/expanders will prove to possess inadequate fundamental properties to enable it to adequately service automotive fuel cells. Conversely, the power demand of aircraft and large sea-going vessels, which is generally a single load, provides an excellent platform to use gas turbine propulsion.

The foregoing has meant to illustrate that while positive-displacement compressors possess the flow and pressure-ratio characteristics required for land vehicle fuel cell propulsion, they are much bigger than turbo-machines that have nonlinear characteristics difficult to deal with in this application. What is needed, therefore, is a positive displacement mechanism that can rival the physical size of turbo-machines. Such a device would therefore incorporate the RPM characteristics required of large 'turn-down' ratio fuel cells but small in weight and size for mobile applications. That is what the present invention achieves.

SUMMARY OF THE INVENTION

Although collateral factors are of importance, a preferred embodiment of the present invention employs the development of centrifugal forces (due to rotation) that are used to its advantage by insuring that the vane is designed and controlled so the center of gravity thereof always rotates (orbits) within the stator bore around the smallest radius of gyration consistent with the geometric limitations of rotor/stator off-set. This is achieved, for instance, by choosing the center of gravity of the vane such that when vane is at the 6 O'clock position shown in FIG. 3*a*, the vane center of gravity is in register with the center of the stator bore. While other points can be chosen with varying result, the stator center turns out to provide the smallest radius of cg gyration. The combination of configuration and elements provided by my invention leaves the tether guide pins to insure the precise location of the vane against only the mild inertial loads and ordinary pressure and frictional forces.

Another important feature inherent in this invention is the radial extension 'tongue' of the vane. This extension not only enables the positioning of the vane cg as desired, but also greatly enhances the load distribution of the vane against the drive side of the rotor slot by significantly increasing the amount of vane "tucked in" to the rotor slot as compared to the vane surface extending into the fluid being compressed.

BRIEF DESCRIPTION OF THE DRAWINGS

FIGS. 6*a*, 6*b*, 6*c*, and 6*d*, respectively, show the rotor and vane in 6 O'clock, 7+O'clock, 9 O'clock, and 12 O'clock positions;

FIG. 6*e* shows an enlarged view of a portion of FIG. 6*a* to better illustrate the means for greatly decreasing radial vane friction and enhancing the distribution of interface loads between the drive side of the rotor slot 176 and the driven side of vane 75 through the use of compressed gas; and FIG. 6*f* shows a cross-section of the rotor as viewed along section lines 6*f*—6*f* of FIG. 6*a*.

DETAILED DESCRIPTION OF THE INVENTION

Figure 1A:
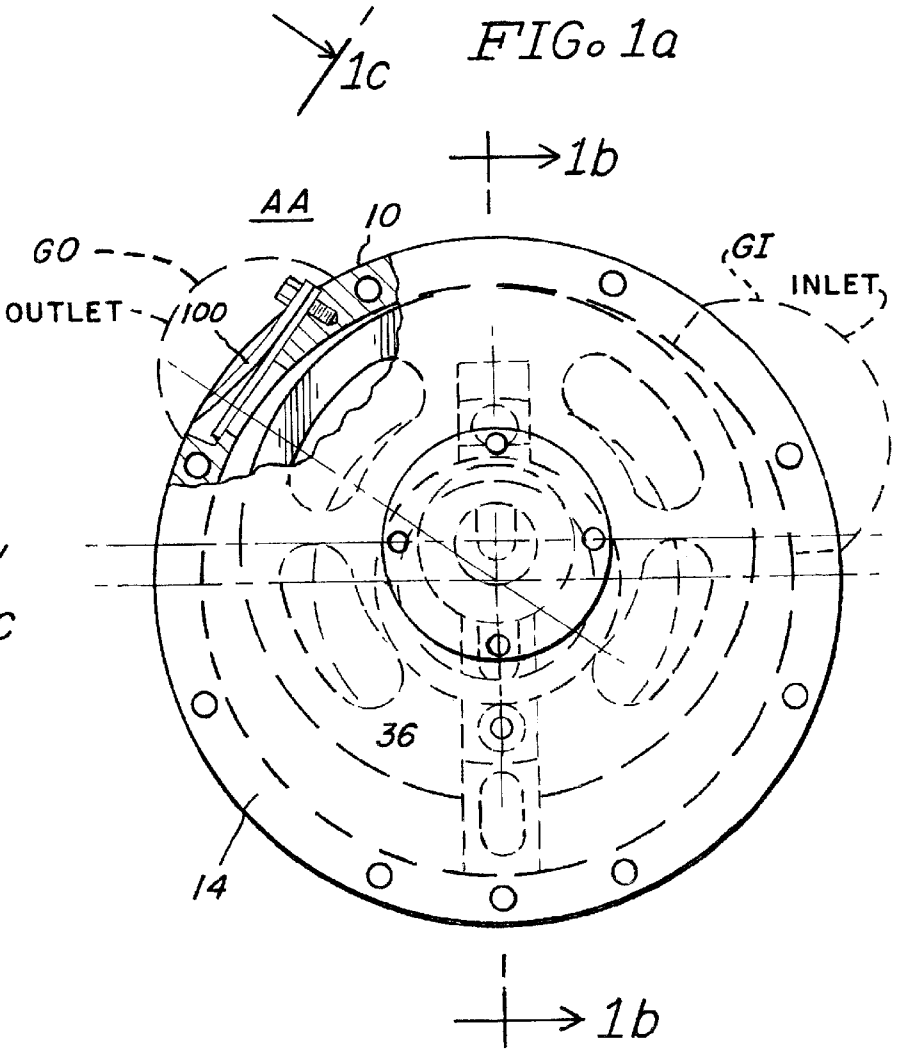
FIGS. 1*a* and 1*b* present face and sectional views of the invention.
Figure 1C:
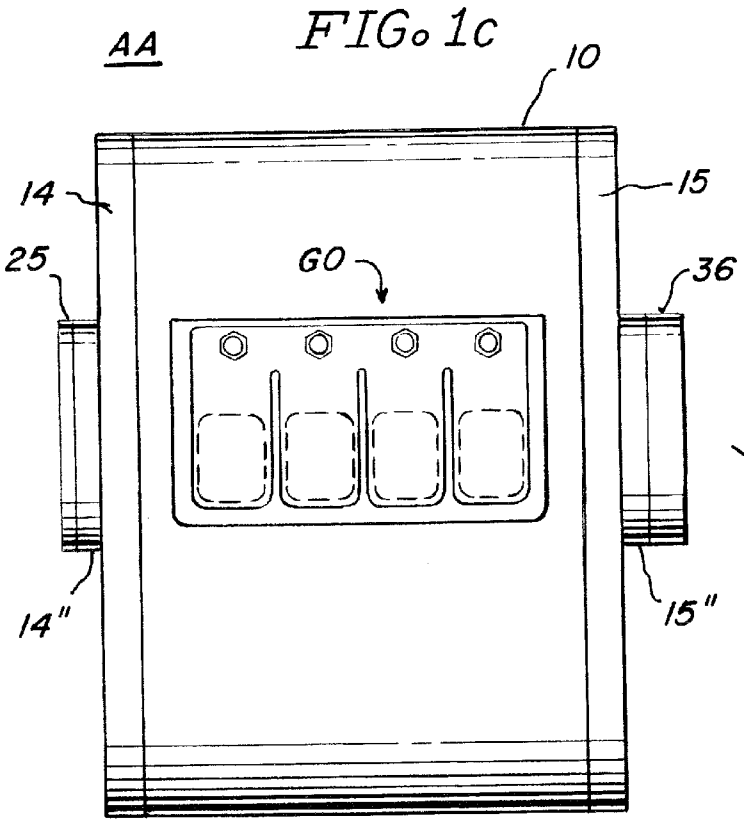
FIG. 1*c* illustrates an orthogonal view of the discharge or outlet reed valve used by the machine as viewed along section lines 1C—1C of FIG. 1*a;*
Figure 1B:
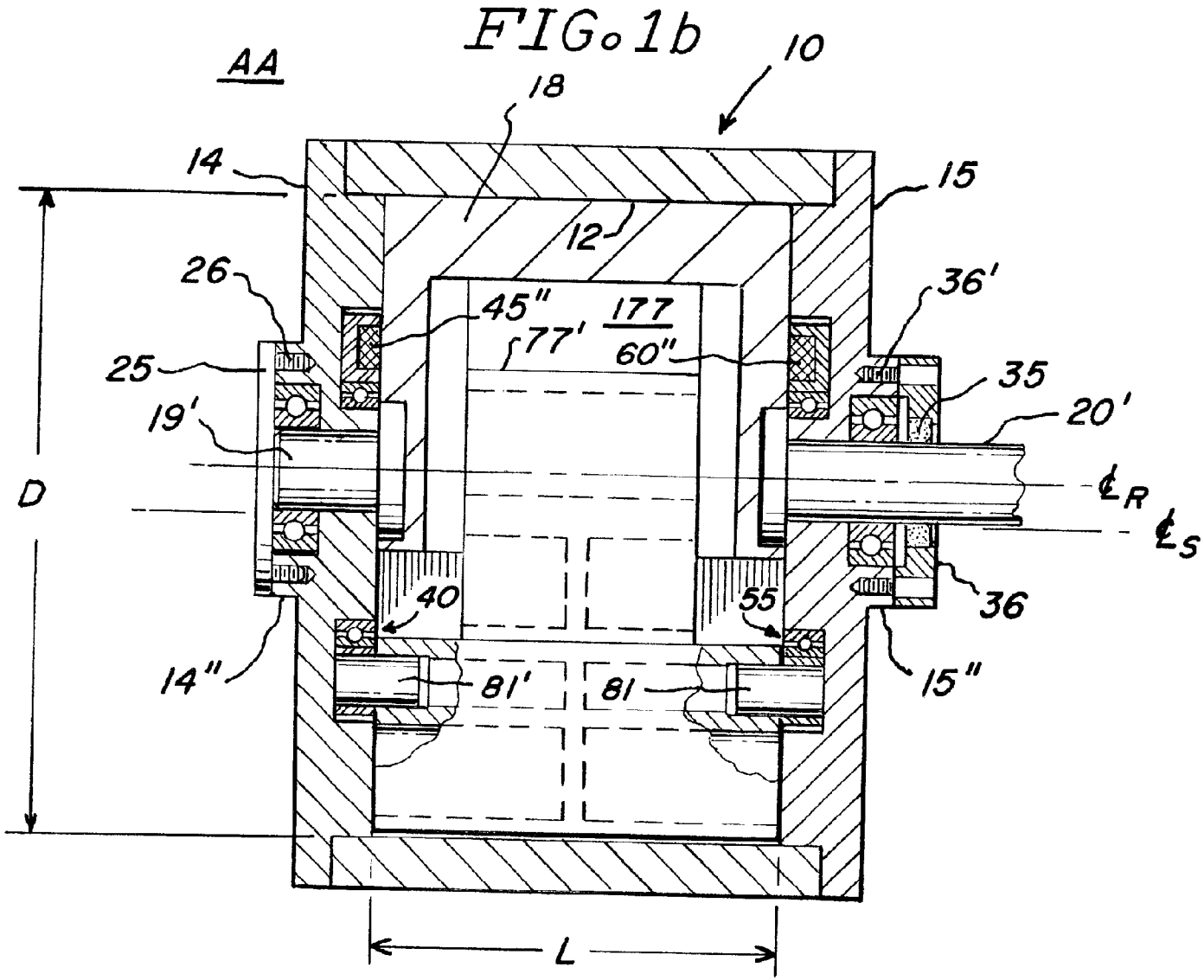
Figure 2A:
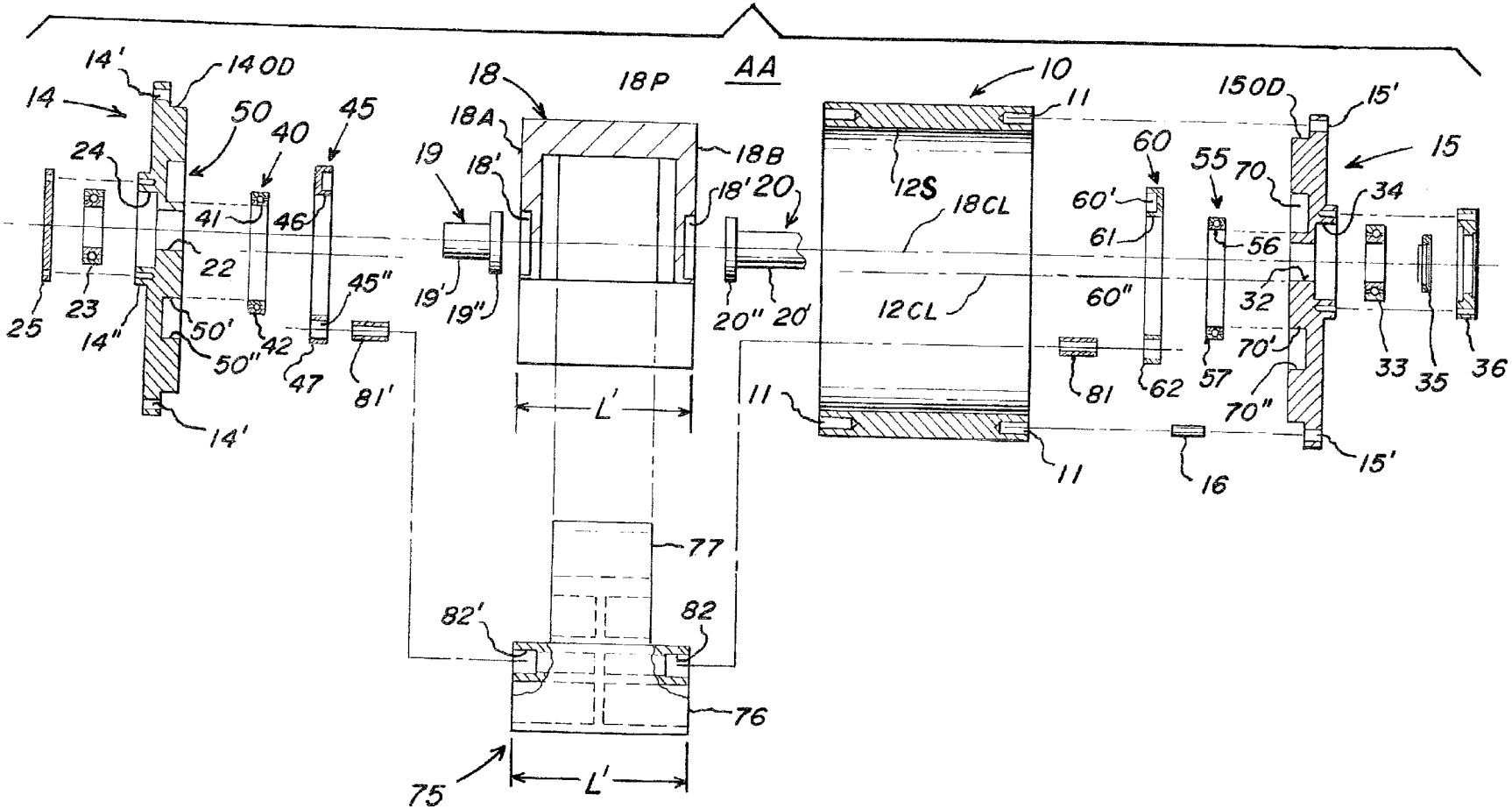
FIG. 2*a* shows an exploded or disassembly view of the device.

Referring to FIGS. 1*a*, 1*b*, and 2*a* of the drawings, a single vane displacement apparatus AA comprises a stator housing 10 having a right cylindrical bore 12 therethrough with a predetermined diameter D. The stator 10 has a predetermined longitudinal axis 12CL and a generally continuous inner surface 12S curved concentrically about the longitudinal axis 12CL.

First and second stator end plate means 14 and 15 are respectively provided with precision-machined bosses with outside diameters 14OD and 15OD adapted respectively to fit into the left and right axial ends of the stator housing 10 as is shown in FIG. 1*b*. Suitable means, i.e., screws, are used to secure endplates 14 and 15 to housing 10. After assembly, the effective preselected axial length of the enclosed space of the stator is designated on FIG. 1*b* by the reference letter L. An alignment pin 16 assures proper alignment of endplate 15 with stator 1O.

Figures 2B, 2C, 2D, 2E, 3A, 3B, 3C:
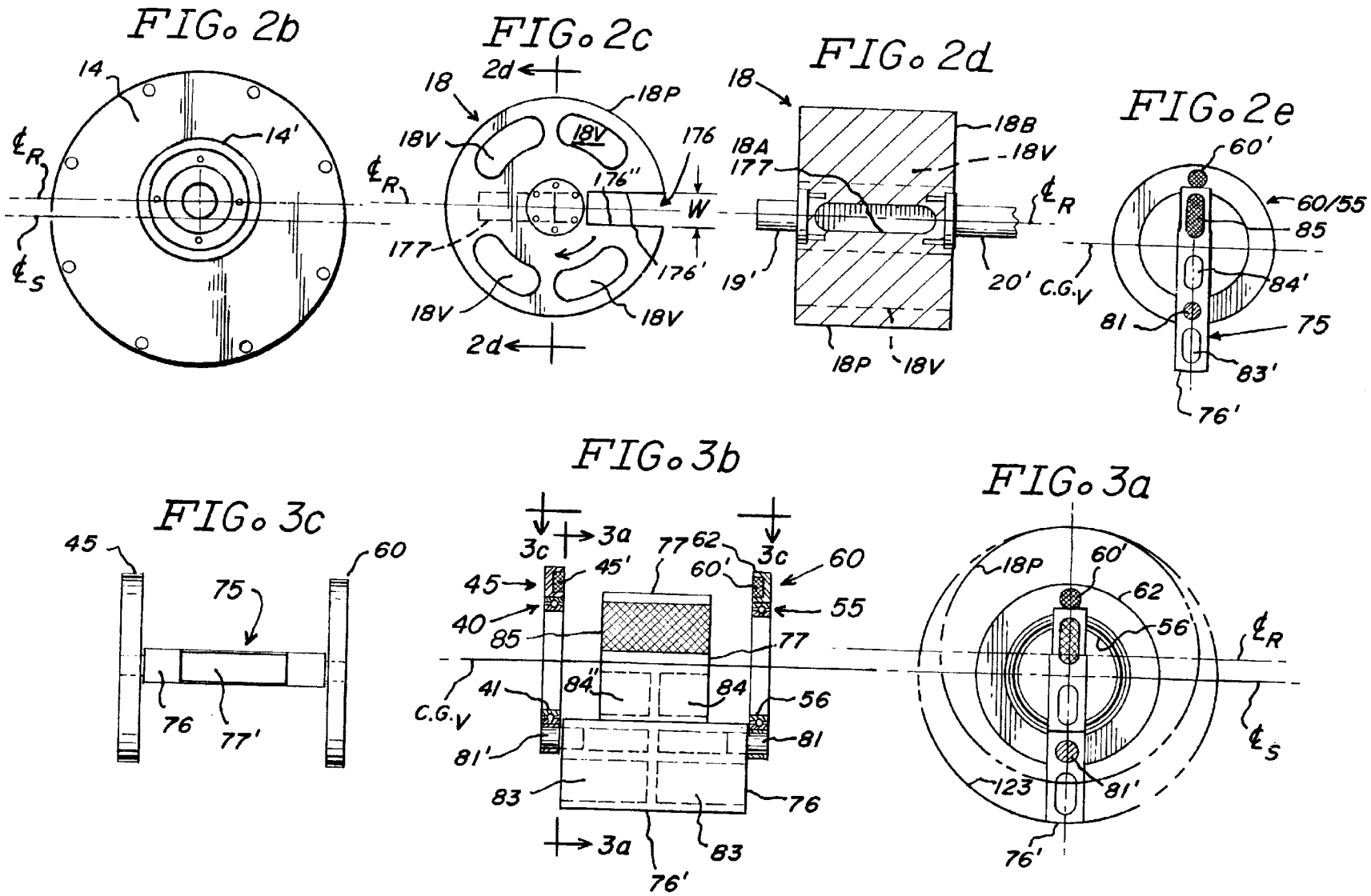
FIG. 2*b* shows an end view of a stator end plate 14.
FIG. 2*c* shows an end view of rotor 18 (note vane slot 176 is in 3 O'clock position)
FIG. 2*d* shows a cross-section of the rotor in a plane which includes the rotor center line, and as viewed along section line 2*d*—2*d* of FIG. 2*c;*
FIG. 2*e* shows a subassembly end view of the vane 75 and associated vane guide bearing (vane in 6 O'clock position)
FIGS. 3*a*, 3*b*, and 3*c* show respectively end, side, and top views of the vane and vane guide mechanism (vane in 6 O'clock position)

A rotor 18 is mounted on rotor shaft means to be eccentrically positioned in the bore 12 of the stator by bearing means in the end plate means 14 and 15 for rotation about a rotor shaft axis 18CL parallel to but spaced a preselected distance from the longitudinal axis 12CL of the stator. More specifically, the rotor 18 is a right cylindrically-shaped member positioned in bore 12 and (referring to FIG. 2*a*) has two axial ends 18A and 18B, a longitudinal length L' preselected to be substantially the same (but slightly smaller) as the preselected effective longitudinal extent L of the bore, as well as a radially extending slot 176 having a preselected slot width W for slidably receiving a vane 75, and terminating at the outer periphery of the rotor as is best shown in FIG. 2*c*. Further, the slot 176 extends longitudinally between the two axial ends of the rotor, also shown in FIG. 2*c*. Again referring to FIG. 2*a*, a pair of recesses 18' and 18" are provided in the axial ends 18A and 18B of the rotor to provide a seat for the inboard ends 19" and 20" of rotor shaft elements 19 and 20 respectively. The outboard ends 19' and 20' of rotor shaft elements 19 and 20 are adapted to be respectively positioned through bores 22 and 32 of end plates 14 and 15 and thence be rotatably supported be the inner races of bearing means 23 and 33, the outer races of which fit within recesses 24 and 34 of outboard bosses 14" and 15" of endplates 14 and 15 respectively, as is clearly shown in FIGS. 2*a* and 1*b*. Bearing sealing plate 25 is connected to end plate 14 with screws 26 (see FIG. 1*b*). The shaft element 20' projects outwardly of the inner race of bearing 33 and thence through central openings of a seal 35 and a bushing 36, which provides a lubricant reservoir for bearing 33.

Thus, right cylindrically-shaped rotor 18 positioned in bore 12 is mounted on and connected to the rotor shaft elements 19 and 20 so as to rotate integrally therewith about the rotor shaft axis 18CL. The bores 22 and 32 are sufficiently sized so as to not restrain the rotation of the rotor.

Prime mover means (not shown) would be adapted to be connected to the rotor shaft element 20' projecting outwardly from the right side of the assembled elements 35 and 36 shown in FIG. 1*b* so as to rotate the rotor relative to the stator about rotor axis 18CL.

Each of the end plates 14 and 15 has an inwardly-facing annular axial recess 50 and 70 respectively, which are concentric with the stator longitudinal axis 12CL (see FIG. 2*a*). Recess 50 has inner and outer diameters 50' and 50" respectively, and recess 70 has inner and outer diameters 70' and 70" respectively.

First and second anti-friction radial vane guide assemblies are provided. The first assembly comprises a bearing 40 having an inside diameter 41 and an outside diameter 42. Bearing 40 is positioned within recess 50 with its inside diameter 41 lightly engaging the inside diameter 50' of the recess. The first vane guide assembly also comprises a vane guide disc 45 having an inner diameter 46, an outer diameter 47, an axially-facing recess 45' and a bore 45" through the lower portion thereof as is shown in FIG. 2*a*. Bore 45" is adapted to receive one end of a connecting roller bearing means 81'. The inner and outer diameters 46 and 47 of the vane guide disc 45 are sized so that bearing 40 and vane guide disc 45 are assembled so as to be coplanar and lying within the recess 50 as is clearly shown in FIG. 1*b*. A preselected clearance is provided between the outer diameter 47 of vane guide disc 45, and the OD 50" of recess 50 so that vane guide disc 45 may freely rotate.

Importantly, it will be seen from FIGS. 2*a* and 1*b* that the vane guide assemblies are concentric with the stator longitudinal axis 12CL, the displacement of this axis from the rotor rotational axis CL being clearly depicted in the drawings.

Referring to the right side of FIG. 2*a*, the second (and identical) anti-friction radial vane guide assembly comprises a bearing 55 and a vane guide disc 60 which are sized so as to be assembled in a coplanar fashion and nested within the annular axial recess 70 in end plate 15. Bearing 55 has an ID 56 and an OD 57; disk 60 has an ID 61 and an OD 62, an axial facing recess 60' and a bore 60" adapted to receive one end of a roller bearing means 81.

The first and second anti-friction radial vane guide assemblies can thus be summarized as comprising an outer race having a preselected diameter, an inner race concentrically and rotatably mounted within said outer race, and said first and second assemblies being respectively mounted in said first and second end plate means of the stator, with the rotational axes thereof being concentric with the preselected longitudinal axis of the stator housing.

The rotor 18 is shown in FIGS. 2*a*, 2*c*, 2*d*, and 6*a–e*. As indicated, the rotor has a radially-extending slot 176 having a preselected slot width W adapted to slidably receive a vane 75, the slot 176 terminating at the outer periphery of the rotor as is clearly shown in FIG. 2*c*, with the slot also extending longitudinally between the two axial ends 18A and 18B, as is shown in FIGS. 2*c* and 6*f*. The slot 176 has a pocket-like radial extension 177 of reduced longitudinal extent as is shown in FIG. 2*d*. The extended slot in rotor 18 provides space for a radial extension 77 of the vane 75. As best shown in FIG. 2*c*, the slot 176 has two spaced-apart parallel faces 176' (drive face) and 176" (trailing face).

The rotor 18, also as is shown in FIG. 2*c*, has a plurality of axially-extending voids 18V for harmonic balancing.

The vane 75 has a main or outer portion 76 with a generally rectangular shape having a longitudinal length L' preselected so as to be essentially the same as the longitudinal length L' of the rotor, and having a thickness preselected to permit the vane to slidably fit within the rotor slot 176 and pocket extension 177. The vane has an outer tip surface 76' and a pair of recesses 82' and 82 for receiving, respectively, one of the other ends of the roller pins 81' and 81. The vane 75 has an inner extension 77 adapted to be inserted into the rotor slot 176/177. It will be understood that the vane is thus rotatably tethered to the vane guide assemblies. (Note also that a through-shaft could also be used.) Thus, when rotational torque is applied to the rotor shaft 20' to cause the rotor to rotate about its axis 18CL, it follows that the vane (being positioned within the rotor slot) also rotates therewith. The vane is sized so that the outer tip surface 76' thereof is adjacent to the inner surface 12S of the stator 10 in a non-contacting but sealing relationship. The inventor's prior U.S. Pat. No. 5,087,183; 5,160,252; and 5,374,172 are incorporated herein for reference.

Thus, the rotor is rotating about its rotational axis 18CL, but the position of the tip surface 76' is controlled by the function of the vane guide discs, i.e., the first and second antifriction radial vane guide assemblies. This is demonstrated in FIGS. 6*a–e*.

Gas inlet means GI and gas outlet means GO are shown in FIG. 1*a*. The gas outlet means GO is shown in more detail in FIG. 1*c* and comprises a plurality of reed valves, the details of which are well known to those skilled in the art. The gas inlet means and outlet means are respectively positioned on opposite sides of a plane defined by the rotor and longitudinal axes.

A most unique feature of the present invention is to have the vane characterized by having the center of gravity thereof preselected to be located proximate to the stator longitudinal axis. This is shown in FIG. 3*a,* where the vane center of gravity CGV is shown to be in register with the center line of the stator 12CL; it will be noted that this is when the vane is in the 6 O'clock position.

Figure 6D:
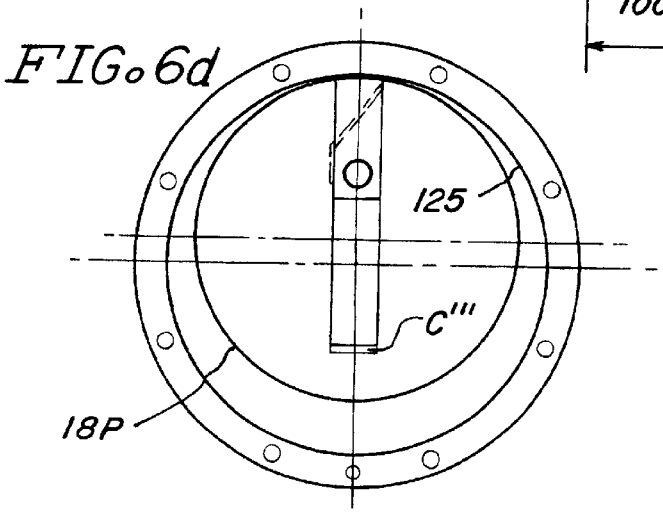

As power is applied to rotor stub shaft element 20, the rotor/vane/vane-guide assembly rotates (clockwise in FIGS. 1*a* and 6). This causes relative radial motion between the rotor slot 176 and the vane 75. As indicated, vane 75 also comprises a radial extension 77 that extends into an extended vane slot pocket 174 as the rotor rotates. When reaching the 12 O'clock position shown in FIG. 6*d*, for instance, the vane 'tongue' 77 fully fills (except for clearance) the rotor slot pocket 177 because it is fully withdrawn into the rotor slot at that angular location.

It is especially advantageous to mount the endplates 14 and 15 to the stator cylinder 10 through the fitting of precision center-bosses 140D and 150D machined into the endplates, to precisely center them with the stator cylinder ID 12. This feature, in combination with the alignment pin arrangement 16, provides very accurate alignment of the rotor bearings 23 and 33. Precision in this alignment is vital to the proper operation of the machine because even small misalignments will cause the rotor to rub against the stator cylinder bore and the faces of both endplates. This condition, of course, not only results in wear and friction, but also additional internal compressor leakage. Therefore, this method of axial machine alignment is very important to maximize the functioning of this invention.

Functional Description Refer again to FIG. 1*a* with attention to the depicted inlet arrow. The circular dotted line associated with this arrow represents the inlet manifold and the inlet ports located in the stator cylinder 10. As air, for example, flows into the compressor though the inlet it follows the trailing edge of the vane portion 76; as it does so, this inlet process fills the machine. Meanwhile, the gas gathered during the previous rotor revolution is being compressed by the motion of the leading edge of the vane (and, of course, with the aid of the surrounding rotor, endplate and stator bore compression surfaces). Note, therefore, that the mechanism simultaneously performs inlet, or intake, and compression. This results in a device possessing very significant economies in size and operation.

As the pressure of the air, or any gas, being compressed in front of the vane reaches a value just above the pressure in the Outlet Manifold (also shown by dotted lines), the discharge reed valve 100 lifts and allows the compressed gas to discharge from the compressor at approximately constant pressure. (FIG. 1*c* shows the orthogonal projection of this valve assembly.) Therefore, the machine, when behaving as a compressor, can closely approximate the ideal set of thermodynamic processes for the positive displacement compression: a) constant pressure inlet, b) polytropic compression process and c) constant pressure discharge.

The foregoing has, in part, restated teachings of the '172 patent, and added structural details of the present invention. The purpose of the present invention, however, is to greatly magnify, i.e., increase, the rate (RPM) at which the UniVane mechanism can operate in order to significantly decrease its size and weight. The specific goal, again, is to increase the UniVane's operating speed to the point so that it, a positive displacement machine, rivals the small size of turbomachines. This essential aspect of the present invention is rooted in relocating the center of gravity of the vane such that the net loads on the drive pin or axle arrangement are greatly minimized and controlled.

As recited earlier, the speed limitation of the '172 patent is related to the radius r of gyration of the center of mass (cg) of the vane. This is because the load on the vane guide pins is a linear function of this radius. That is, centrifugal acceleration=$rw^2$, where r is the radius of gyration of the vane center of mass, and w is radial velocity. Clearly, the smaller this radius, the smaller the centrifugal forces because they are the product of the vane mass and the centrifugal acceleration of the cg of the rotating mass.

Refer next to FIGS. 3*a*, 3*b*, and 3*c* that show end, side, and top views of the central elements by which the present invention achieves high-speed operation. This aspect of the mechanism includes the vane 76 portion, its extension, or tongue 77, counterweight voids 83, 83', 84, and 84', counterweight 85, vane guide pins 81 and 81', vane guide discs 45 and 60, the respective vane guide disc bearings 40 and 55, and vane guide disc counterweights 45' and 60'. Note at 6 O'clock, the embodiment shown in FIGS. 3*a–c*, the configuration and distribution of the mass of the vane is arranged in such a way that the center of mass of the vane is in register with or corresponds to the center line of the stator bore (which is also the center line of the vane guide bearings and vane guide discs). This is achieved, variously, by employing vane counterweight voids 83, 83', 84, and 84', and a vane counterweight 85 such that the center of mass at these two angular locations corresponds to said stator and vane guide center.

Figure 4:
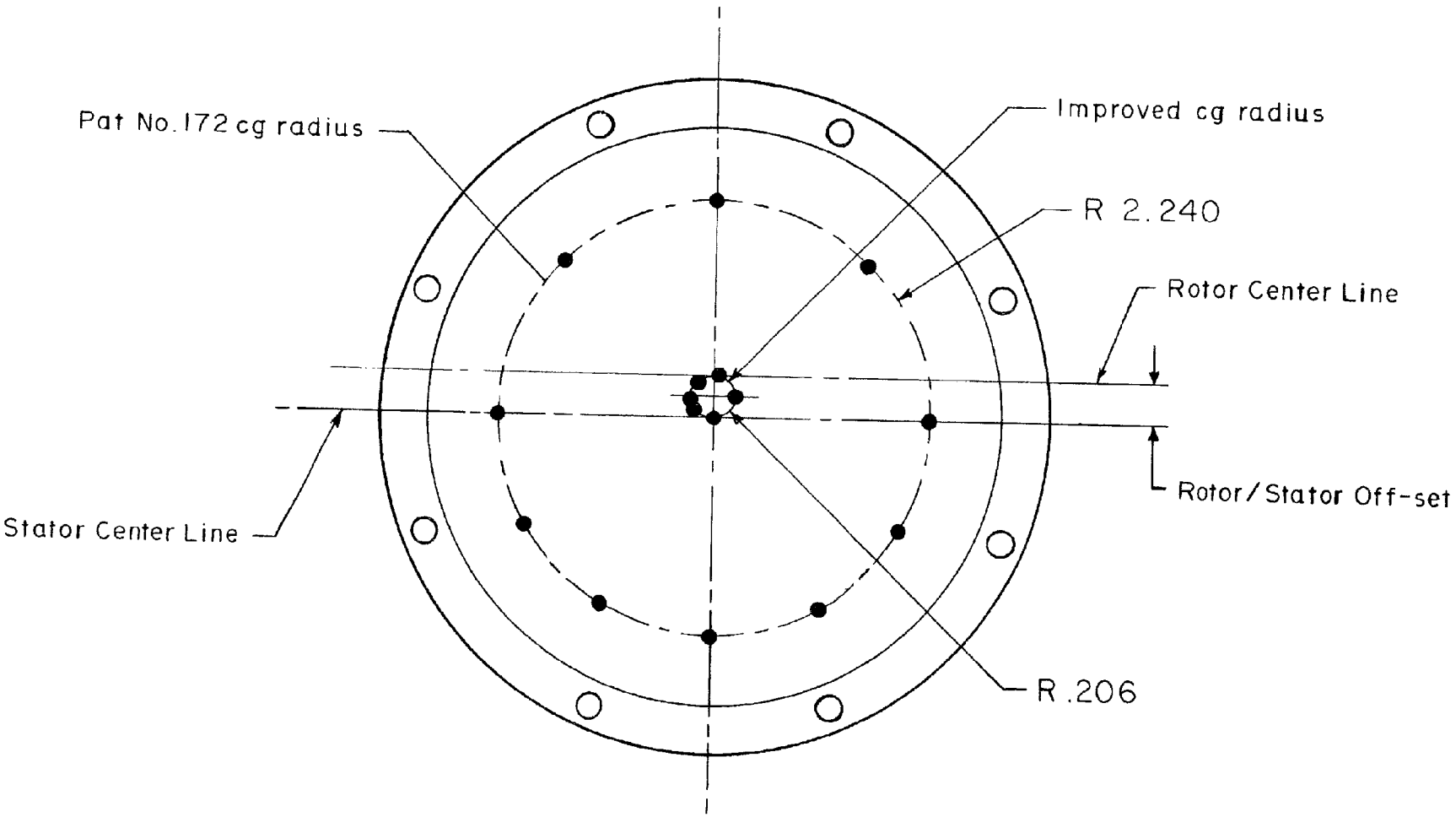
FIG. 4 is an axial or end view of the stator showing the dramatic difference between the size of the center of gravity radii for the '172 invention and the present invention, the latter being much smaller than the former.

Refer now to FIG. 4; it graphically illustrates the very significant reduction in the radius of gyration of the center of mass of the vane in the present invention compared to the '172 Specifically, the radius of gyration of a '172 vane in an actual machine design is approximately 2¼" (57 mm). On the other hand, in the identical size and displacement improved machine, this radius is reduced to about ⅕" (5 mm). This reduction in radius of gyration is more than an order of magnitude and drastically increases the speed capability of the UniVane machine. This gyrational radius cannot be reduced to zero because of the rotor offset that is required to cause volumetric change within the compressor. The particular rotor/stator offset highlighted herein causes the actual rotation of the improved vane center of gravity to be about an axis that is half-way between the rotor and stator axes.

Note also in FIG. 3*b* that counterweights 45' and 60' are installed on the vane guide discs. These are added in order to counter-balance the centrifugal loads created by the vane drive pins 81 and 81'. As well, counter voids 18V are strategically placed and sized in the rotor 18 as shown in FIG. 2*c*, for example, to make up for the mass void created by the rotor slot 176 and its attendant secondary pocket slot 177 (which houses the vane tongue extension 77). That is, these counter-voids cause the rotor to become dynamically balanced. However, it is also important to note that the placement of these rotor counter-voids 18V can be such that they offer a secondary counter-balance that will, for example, aid in nulling-out secondary vibrations delivered by the small but finite radius of gyration of the center of gravity of the vane.

Figure 5A:
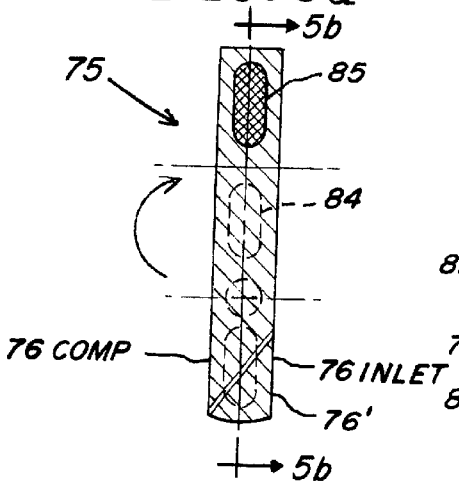
FIG. 5*a* shows a cross-section of a preferred embodiment of a very low-mass, high strength vane as viewed along section lines 5*a*—5*a* of FIG. 5*b* which shows a cross-section of the vane as viewed along section lines 5*b*—5*b* of FIG. 5*a;*
Figure 5B:
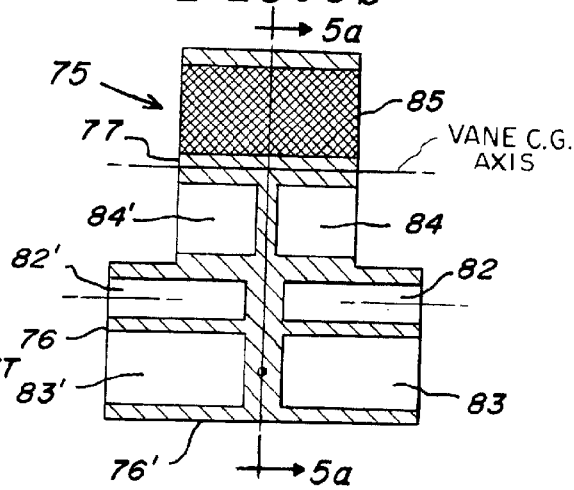
FIGS. 5*c* and 5*d* are views corresponding to FIGS. 5*a* and 5*b* respectively for an alternate very low-mass, high strength vane construction.

Even though using the counterweighted vane and, therefore, greatly decreasing the loads that the vane guide pins or axels 50 must withstand, it is nonetheless worthwhile to fit the compressor with as low a mass vane as possible, consistent with adequate structural strength and cost, because the vane mass linearly influences the vane guide pin loads. FIG. 5 offers additional details and information regarding preferred low-mass vane embodiments. FIGS. 5*a* and 5*b* provide details of vane 40 as described above. This vane embodiment achieves both a lower mass and a significantly shifted cg by strategically placing mass-less voids 83, 83', 84, and 84', (thus lightening the vane) and counterbalancing the remaining moment of vane mass by the placement and value of the counterweight 85.

Figure 5C:
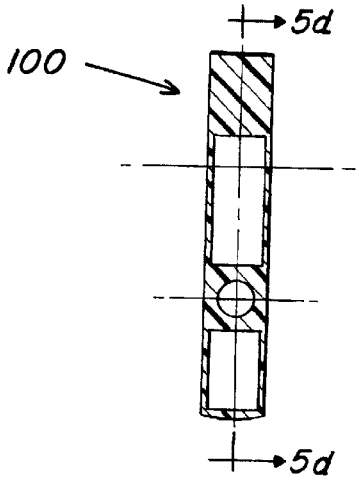
Figure 5D:
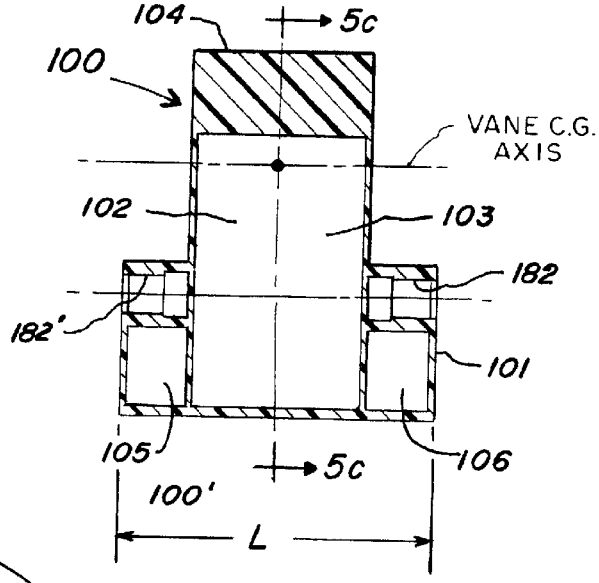

On the other hand, FIGS. 5*c* and 5*d* show an alternative 'built-up' vane construction wherein the vane surfaces are constructed of thin, light high-strength engineering materials such as carbon fiber reinforced polymers that are bonded together with or without internal structural supports such as "honeycomb" material. In this specific case, for example, counterweight 104 consists of and is sized such that it balances the vane across its desired center of gravity. Such constructions can yield surprisingly strong and light vanes; weighing on the order of a few ounces.

As discussed earlier, the extended tongue 77 of the vane 76 is very effective in greatly decreasing the interface stress concentration between the driven (trailing) surface of the vane and the driving (also trailing) surface of the rotor slot near the rotor OD. Again, this is due to the favorable force-moments acting on the vane wherein only a small amount of the total vane height actually extends out of the slot. While such an embodiment certainly improves the wear situation at this location, the amount of frictional loss (Coulomb friction) that occurs as the vane 75 reciprocates within the slot 176/177 is essentially independent of the vane/vane slot contact stress distribution.

In FIG. 5*a*, the leading radial surface of vane 75 is designated 76COMP (for compression side) and the trailing radial surface by "76 inlet,"i.e, in connection or communication with the gas (air) inlet means GI of the UniVane compressor AA.

It has therefore proven advantageous to employ a unique means to greatly diminish the coefficient of friction at this reciprocating interface; see FIGS. 5*a* and 6*a–f*. The embodiment shown magnified in FIG. 6*e* best shows how the pressure building up on the leading surface or flank of the vane (Pcomp) to transfer to a shallow pocket or "pad" 18AA placed in the drive side 176' of the rotor slot 176 via a small transverse port, bore, or hole 75P. As can be noted in the 6 O'clock, 7 O'clock, 9 O'clock, and 12 O'clock positions of the rotor shown in FIGS. 6*a*, 6*b*, 6*c*, and 6*d* respectively, as the pressure in the gas being compressed builds up ahead of the vane due to the rotor and assembled vane rotating relative to the stator, this increasing pressure is almost instantly transferred through the port 75P to the shallow 'air bearing' pad 18AA in the drive side of the rotor slot 176.

Therefore, as can be seen in the four different rotor/vane angular locations, this method of pressure transference insures that the opposing pressure within the air bearing pad 34 increases with rotation to help lift the vane away from contact with the drive surface of the rotor slot. That is, the opposing air pressure in the air bearing pad region 34 exactly follows the angular pressure profile developed within the machine. Such an arrangement, although very simple in embodiment, automatically 'load follows' the developing pressure within the compressor and therefore ensures that the opposing pressure force within the air pad 18AA will develop in exact accordance with what is required to minimize drive friction. Such an improvement is especially important when operating the machine "dry" such as is required to supply air to fuel cells.

Thus, the present invention greatly increases the speed capability and efficiency of the UniVane mechanism through the judicious use of properly located mass-centers of the vane and the rotor, as well as to minimize actual machine vibration and friction. Note, for example that the vane extension, while shown as a flat (or stepped) tongue herein, can consist of any embodiment whose purpose is to insure that the moment of mass of the vane on the opposite side of the chosen vane cg axis is counter-balanced. Note, however, that the use of a flat extension tongue also produces the very important advantage of minimizing the force and stress concentration against the drive surface of the vane in the vicinity of the rotor slot OD terminus. Note also that when reference is made to 'compression,' this term includes compression, expansion, or pumping.

While the preferred embodiment of the invention has been illustrated, it will be understood that variations may be made by those skilled in the art without departing from the inventive concept. Accordingly, the invention is to be limited only by the scope of the following claims.

I claim:

1. A single vane displacement apparatus comprising:

A) a stator housing having a right cylindrical bore therethrough, said bore having a preselected diameter, a preselected longitudinal axis, and a generally continuous inner surface curved concentrically around said longitudinal axis;

B) first and second stator end plate means attached to said housing at each end of said circular bore to define an enclosed space within said housing having a preselected longitudinal length;

C) first and second spaced apart rotor shaft elements eccentrically positioned in said bore and respectively supported by bearing means in said first and second stator end plate means for rotation about a rotor axis parallel to but spaced from said longitudinal axis a preselected distance;

D) a right cylindrically-shaped rotor positioned eccentrically within said bore and having first and second axial ends respectively connected to said first and second spaced apart rotor shaft elements for rotation therewith about said rotor axis, said rotor having (i) a preselected diameter, (ii) a longitudinal length preselected to be substantially the same as said preselected longitudinal length of said enclosed space within said bore, and (iii) a radially-extending slot having a preselected slot width, said slot having (a) an outer portion extending from the outer periphery of said rotor radially inward a first preselected distance and also extending longitudinally between said first and second axial ends of said rotor; and (b) an inner pocket portion integral with and radially aligned with said outer portion and extending radially a preselected distance beyond said rotor axis, said inner pocket portion being axially spaced from said first and second axial ends of said rotor;

E) first and second anti-friction radial vane guide assemblies each comprising an outer race having a preselected diameter, an inner race concentrically and rotatably mounted within said outer race, said first and second assemblies being respectively rotatably mounted in said first and second end plate means with the rotational axes thereof being concentric with said preselected longitudinal axis of said stator housing;

F) attachment means connected to one of the races of said first and second vane guide assemblies;

G) a T-shaped unitary vane positioned in said radially aligned outer and inner pocket portions of said radially extending rotor slot for relative radial movement therewith and having a preselected thickness to permit said vane to slidably and radially move within said rotor slot, said vane having i) an outer portion having a) a generally rectangular shape with a longitudinal length preselected to be essentially the same as said longitudinal length of said rotor; and b) an outer tip surface; and ii) an inner portion sized to slidably fit into said inner pocket portion of said radially extending slot, and said vane further being rotatably connected to said attachment means of said vane guide assemblies and being positioned within said rotor slot with said outer tip surface thereof being adjacent to said inner surface of said bore in a non-contacting but sealing relationship;

H) gas inlet means and gas outlet means mounted on said housing and respectively positioned on opposite sides of a plane defined by said longitudinal and rotor axes;

I) means for rotating said assembled rotor and vane about said rotor axis relative to said housing; and J) said vane being further characterized by having a preselected center of gravity located proximate to said stator longitudinal axis.

2. The single vane displacement apparatus of claim 1, further characterized by said preselected center of gravity of said vane being located between said stator longitudinal axis and said rotor axis.

3. The apparatus of claim 1, wherein said preselected center of gravity of said vane is equidistant from said stator longitudinal axis and said rotor axis.

* * * * *